US006059591A

United States Patent [19]

Bolen et al.

[11] Patent Number: 6,059,591

[45] Date of Patent: May 9, 2000

[54] WATER RESISTANT ELECTRICAL CONNECTOR

[75] Inventors: Patrick Bolen; James Pettit, both of Carthage; John Ewers, Loraine, all of Ill.

[73] Assignee: Methode Electronics, Inc., Chicago, Ill.

[21] Appl. No.: 09/293,164

[22] Filed: Apr. 16, 1999

[51] Int. Cl.[7] ..... H01R 35/04

[52] U.S. Cl. ..... 439/164; 439/15

[58] Field of Search ..... 439/164, 15, 587–589, 439/76.1

[56] References Cited

U.S. PATENT DOCUMENTS 5,229,544 7/1993 Horiuchi et al. ..... 439/164

5,743,555 4/1998 Durrani ..... 439/15

5,904,585 5/1999 Nishikigi et al. ..... 439/164

*Primary Examiner*—Gary F. Paumen

*Attorney, Agent, or Firm*—Karl D. Kovach; David L. Newman

[57] ABSTRACT

An electrical connector such as a clockspring having a seal for sealing liquids and pressurized liquids, especially water, from ruining electrical connections existing within the clockspring. In one embodiment the clockspring includes a seal, where the seal prevents the liquid from corrupting the electrical connections existing within the clockspring. In another embodiment the clockspring includes a a housing, a cover, an electrical ribbon cable attached to an outer diameter circuit board, and a seal positioned between the housing and the outer diameter circuit board.

20 Claims, 6 Drawing Sheets

Fig. 4
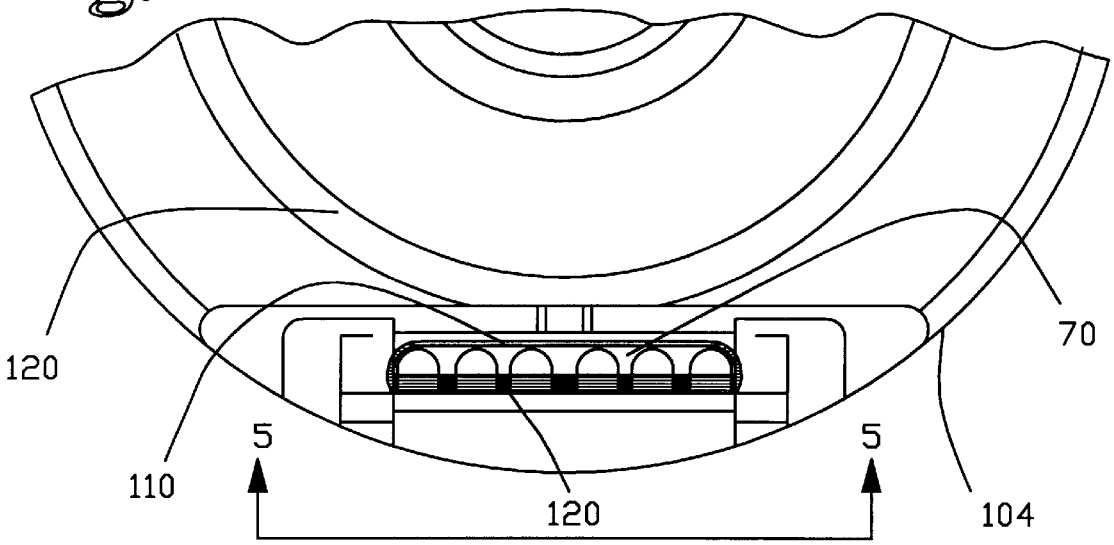
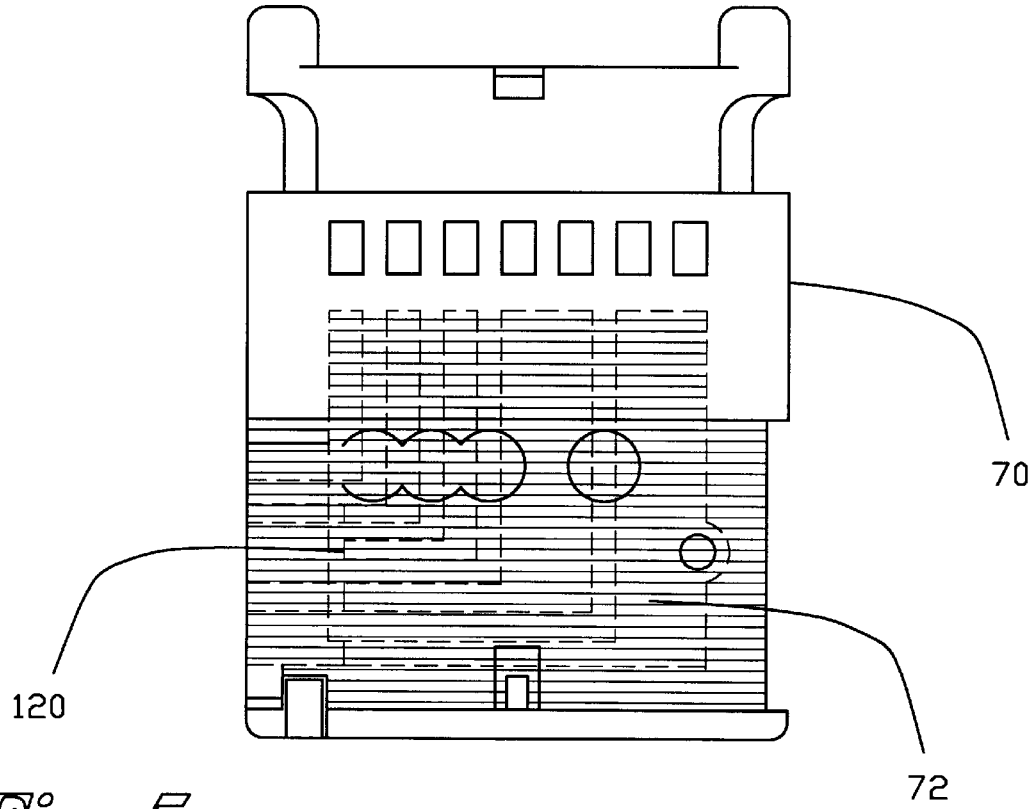
Fig. 5

WATER RESISTANT ELECTRICAL CONNECTOR

BACKGROUND OF THE INVENTION

1. Field of the Invention

The present invention relates to electrical connectors such as a rotary transducer or clockspring used in automotive applications. The invention more particularly concerns the sealing of internal circuit connections of the electrical connectors such as clocksprings from pressurized and non-pressurized liquids, especially water.

2. Discussion of the Background

An increasing number of automobiles include airbags as one part of an overall safety program. Airbags are increasingly looked upon as being the most important safety feature of an automobile. A clockspring is a rotary electrical connection between the airbag located on the steering wheel and the stationary crash impact sensors located elsewhere on the vehicle. Thus, if an airbag is to deploy, the electrical signal travels from the crash sensors to the airbag assembly via the electrical circuits and connections contained within the clockspring. Thus, the integrity of the electrical connections contained within the clockspring are of the upmost importance.

A current trend in the automotive industry is to produce convertible versions of many of the popularly selling automobile models. A convertible automobile is one in which the vehicle has no top, or the top is removable. In any case, the interior of the automobile is exposed to environmental elements. Environmental elements may include rain, fog, snow, pressurized water from a hose at a car wash, or any other element as can be found in the out-of-doors. Convertible automobiles are marketed as fun vehicles to drive and are increasingly being bought as a person's sole vehicle. Thus, convertible automobiles are being exposed to year round use during all four seasons. Also, many of the convertible automobiles are not garaged, but are parked on the street.

Convertible automobiles pose a special new hazard when combined with the recent prevalent use of airbags in automobiles. Namely, after the interior of the convertible vehicle is exposed to environmental elements will the electrical connections contained within the clockspring maintain their integrity so that the airbag will deploy when required to do so. At a minimum, a clockspring having corrupted electrical connections is a nuisance since the steering column of the vehicle will need to be disassembled so that a new clockspring can replace the damaged clockspring. Such a replacement of the fouled clockspring costs money and takes time to repair, since automotive repair work on steering columns is complicated.

Applicants are not presently aware of prior art that discloses or suggests the problems imposed by using conventional clocksprings in a convertible automobile application as has been recognized by Applicants.

Thus, there is a need for a clockspring which prevents the entrance of pressurized and non-pressurized liquids found in the environment from corrupting the electrical connections contained within the clockspring.

Furthermore, the use of water resistant compounds with electrical connectors can have benefits for other automotive applications and non-automotive applications as will be appreciated by reviewing the following description.

SUMMARY OF THE INVENTION

It is an object of the invention to provide an electrical connector such as a clockspring having the ability to resist the pressurized and non-pressurized liquids found in the environment from fouling electrical connection contained within the clockspring.

In one form of the invention the clockspring includes a seal.

In yet another form the invention, the clockspring includes a housing, a cover mounted on the housing so as to form a cavity. Within the cavity is placed electrical ribbon cable. Mounted between the housing and the cover is a circuit board, where the circuit board is connected to the electrical ribbon cable. Positioned between the circuit board and either one or both of the housing and the cover is a seal.

In another form of the invention, the clockspring includes a housing and a cover mounted on the housing so as to form a cavity therebetween. Rotatably mounted to either one or both of the housing and the cover is a hub. Mounted in the cavity is an electrical ribbon cable having first and second ends. Connected to the first end of the electrical ribbon cable is an outer diameter circuit board. The outer diameter circuit board being mounted between the housing and the cover. Positioned between the housing and the outer diameter circuit board is a first seal. A second seal being positioned between the outer diameter circuit board and the cover. Connected to the second end of the electrical ribbon cable is an inner diameter circuit board. The inner diameter circuit board being mounted on the hub. Mounted on the hub is a clip. Positioned between the hub and the inner diameter circuit board is a third seal. Positioned between the inner diameter circuit board and the clip is a fourth seal.

Thus, Applicants' invention achieves the objectives set forth above. Applicants' invention provides a clockspring which prevents pressurized or non-pressurized liquids, especially water, from fouling electrical connections contained within the clockspring. Thus, a convertible automobile having its top down while being exposed to rain will have electrical connections within its clockspring which maintain their integrity. Therefore, even in inclement environments the clockspring connector will function appropriately and will enable the airbag to inflate if call upon to do so. No prior art clockspring discloses such an invention.

Applicants note that the inventive concept can be employed for virtually every electrical connection within the passenger compartment of a vehicle. As a non-limiting example, a multi-function switch embedded within the directional stalk which is connected to the steering column of the vehicle. The multi-function switch can employ the use of seals to make the multi-function switch water resistant as is in the clockspring of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 is a detailed view of FIG. 2 showing the inner diameter circuit board and seals;

FIG. 5 is a detailed side view of the inner diameter circuit board taken along line 5—5 of FIG. 4;

DETAILED DESCRIPTION OF THE PRESENTLY PREFERRED EMBODIMENT

Figure 1:
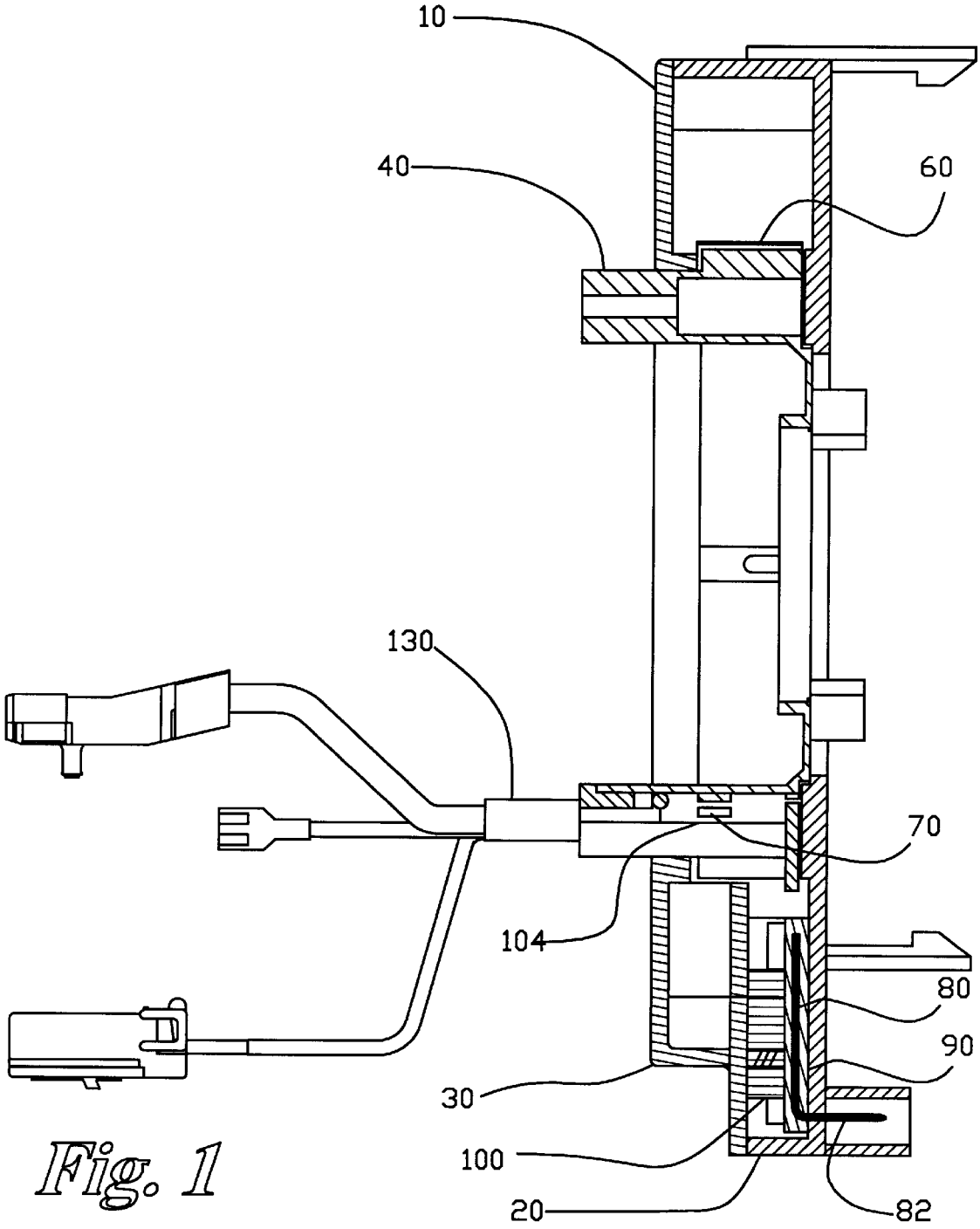
FIG. 1 is a side cross-sectional view of a clockspring, where the figure shows the housing, cover, electrical ribbon cable, and the hub.

Referring now to the drawings, wherein like reference numerals designate identical or corresponding parts throughout the several views, and more particularly to FIGS. 1–8 thereof, an embodiment of the present invention is a clockspring 10 having seals is displayed therein. FIG. 1 is a side cross-sectional view of the clockspring 10 including a housing 20, a cover 30, a hub 40, a clip 104, an inner diameter circuit board 70, an outer diameter circuit board 80, a first seal 90, a second seal 100, and an electrical ribbon cable 60. It may be understood that the circuit boards may be formed of a plastic substrate having conductive traces insert molded therein, such as disclosed in U.S. Pat. No. 5,460,535 which is hereby incorporated by reference. The housing 20 and the cover 30 of the clockspring 10 are consistent with housings and covers as found on conventional clocksprings. A cavity 50 exists between the cover 30 and the housing 20, when the cover 30 is attached to the housing 20. A hub 40 is rotatably mounted within the cavity 50 and rotates relative to the stationary housing 20 and cover 30. The electrical ribbon cable 60 fits within the cavity 50 and is bounded by the hub 40, the cover 30, and the housing 20. The electrical ribbon cable 60 has two terminal ends, a first end and a second end (the first and second ends are not shown in the figures). The first end of the electrical ribbon cable 60 is attached to the outer diameter circuit board 80. The second end of the electrical ribbon cable 60 is attached to the inner diameter circuit board 70. The inner diameter circuit board 70 is attached to the hub 40. The clip 104 also attaches to the hub 40, and maintains the attachment of the inner diameter circuit board 70 to the hub 40. The clip 104, in a preferred embodiment, is a plastic member having complementary features to the inner diameter circuit board 70 for capturing electrical wires therein. A wire harness 130 connects to the inner diameter circuit board 70 at one end and attaches to the airbag assembly at the other end. The housing 20 is attached to the stationary steering column of the vehicle.

The outer diameter circuit board 80 is mounted between the housing 20 and the cover 30. The first seal 90 is shown as being positioned between the housing 20 and the outer diameter circuit board 80 so as to cover and seal the exposed electrical connection between the conductors 82 of the outer diameter circuit board 80 and the conductors of the first end of the electrical ribbon cable 60. The second seal 100 is positioned between the outer diameter circuit board 80 and the cover 30 so as to cover and seal the exposed connection between the conductors 82 of the outer diameter circuit board 80 and the conductors of the first end of the electrical ribbon cable 60.

Figure 2:
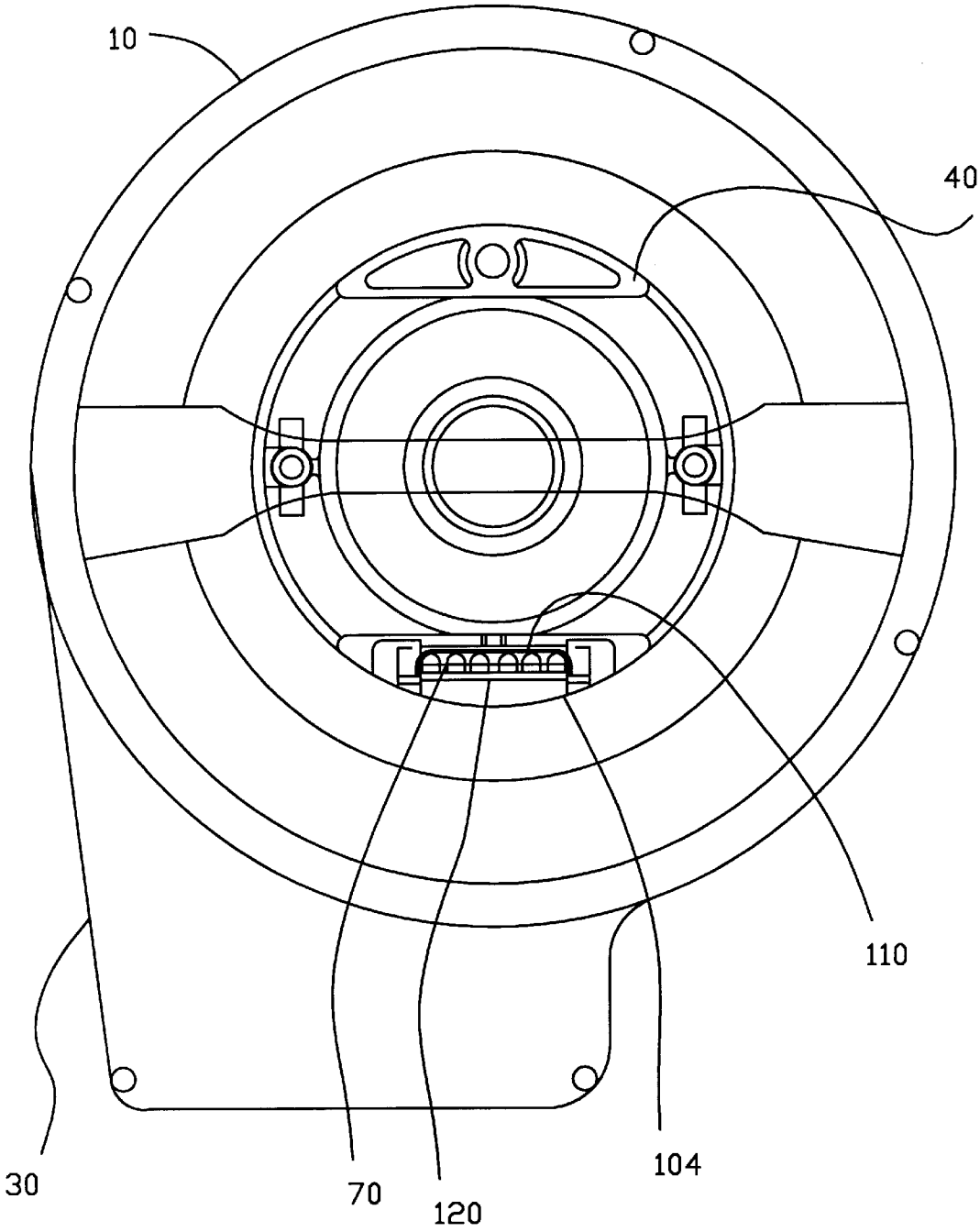
FIG. 2 is a top view of the clockspring of FIG. 1.

FIG. 2 is a top view of the clockspring 10. FIG. 2 shows the hub 40 mounted in the clockspring 10 and being retained by the cover 30. The inner diameter circuit board 70 is shown with the wiring harness 130 removed. The third seal 110 is positioned between the hub 40 and the inner diameter circuit board 70 so as to cover and seal the electrical connection between the conductors of the inner diameter circuit board 70 and the conductors of the second end of the electrical ribbon cable 60. The clip 104 is shown as maintaining the inner diameter circuit board 70 against the hub 40. The clip 104 also attaches to the hub 40. The hub 40 has tangs which entrap the clip 104 and presses the inner diameter circuit board 70 towards the center of the hub 40 via the clip 104. The tangs are not visible in FIGS. 2 and 4 since the cover 30 obstructs the view. A fourth seal 120 is positioned between the clip 104 and the inner diameter circuit board 70 so as to cover and seal the electrical connection between the conductors of the inner diameter circuit board 70 and the conductors of the second end of the electrical ribbon cable 60.

Figure 3:
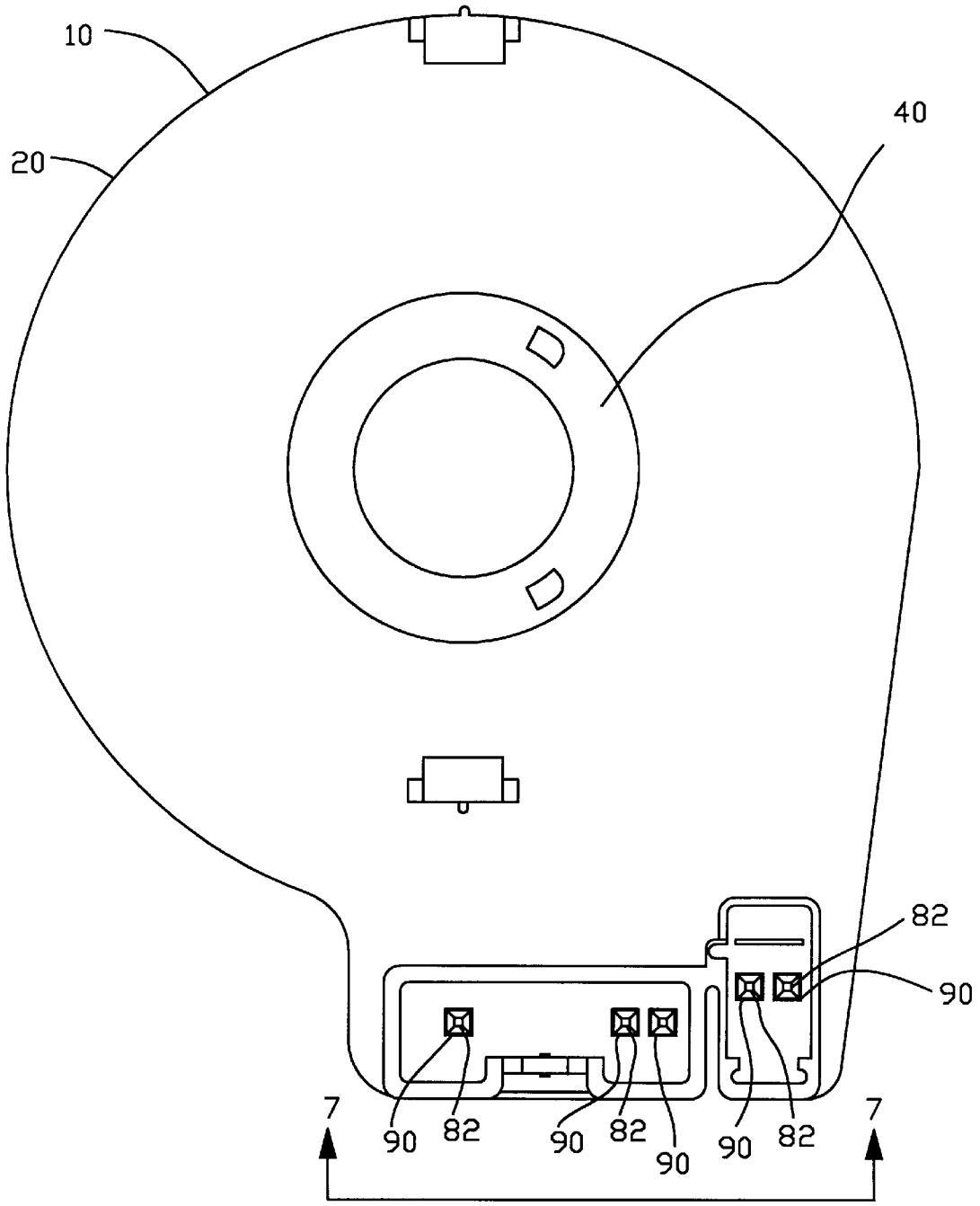
FIG. 3 is a bottom view of the clockspring of FIG. 1.

FIG. 3 is a bottom view of the clockspring 10. FIG. 3 shows the housing 20 and the hub 40. FIG. 3 further shows the conductors 82 of the outer diameter circuit board 80 exiting the housing 20 ready to connect to other conductors of the vehicle. Also shown are portions of the first seal 90 through which the conductors 82 protrude.

FIG. 4 is a detailed view of FIG. 2 showing an area surrounding the inner diameter circuit board 70 as it is positioned within the hub 40. The clip 104 is press fitted by tangs of the hub 104 against the inner diameter circuit board 70 (tangs not shown). The wire harness 130, as was shown in FIG. 1, is removed. The third seal 110 is positioned between the hub 40 and the inner diameter circuit board 70. The fourth seal 120 is positioned between the inner diameter circuit board 70 and the clip 104.

FIG. 5 is a detailed side view of the inner diameter circuit board 70 taken along line 5—5 of FIG. 4 with the hub 40 and clip 104 removed from view. The transparency of the fourth seal 120 makes apparent circuit traces 72 on the inner diameter circuit board 70. However, in another embodiment the seal 120 need not be made of a transparent material.

Figure 6:
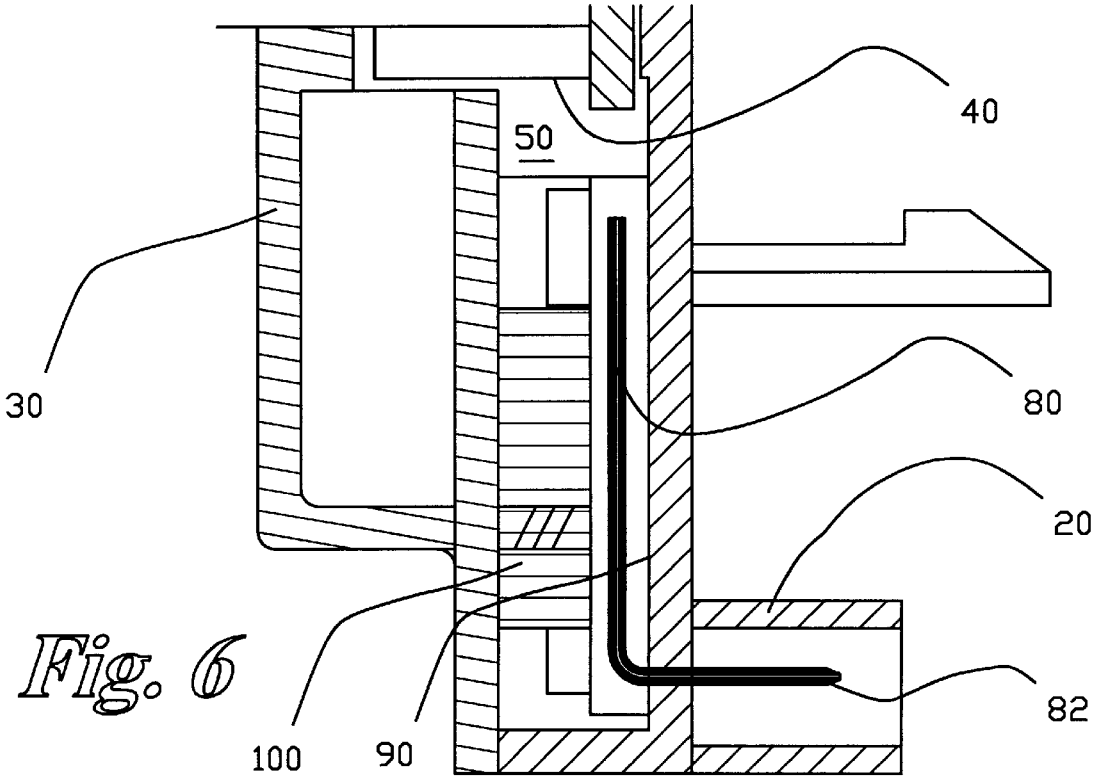
FIG. 6 is a detailed, partial, cross-sectional view of FIG. 1 showing the outer diameter circuit board and seals.

FIG. 6 is a detailed partial cross-sectional view of the area around the outer diameter circuit board 80 of FIG. 1. The hub 40 is retained in the cavity 50 by the housing 20 and the cover 30. The outer diameter circuit board 80 has its electrical connections with the conductors of the first end of the electrical ribbon cable 60 covered and sealed with the first seal 90 on its one side and by the second seal 100 on its other side.

Figure 7:
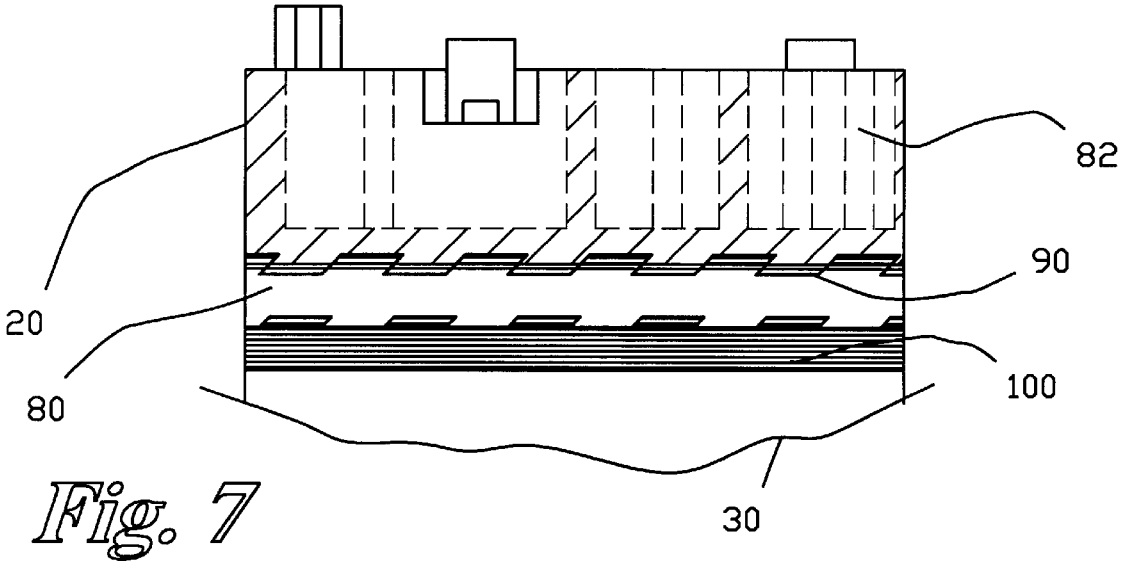
FIG. 7 is a detailed side view of the outer diameter circuit board taken along line 7—7 of FIG. 3.

FIG. 7 is a detailed, partial, cross-sectional side view of the outer diameter circuit board 80 taken along line 7—7 of FIG. 3. The conductors 82 which connect to the outer diameter circuit board 80 are shown in phantom line. The housing 20 is shown to shelter the sides of the conductors 82 along their length. The first seal 90 is positioned between the outer diameter circuit board 80 and the housing 20 and the second seal 100 is positioned between the cover 30 and the outer diameter circuit board 80.

Figure 8:
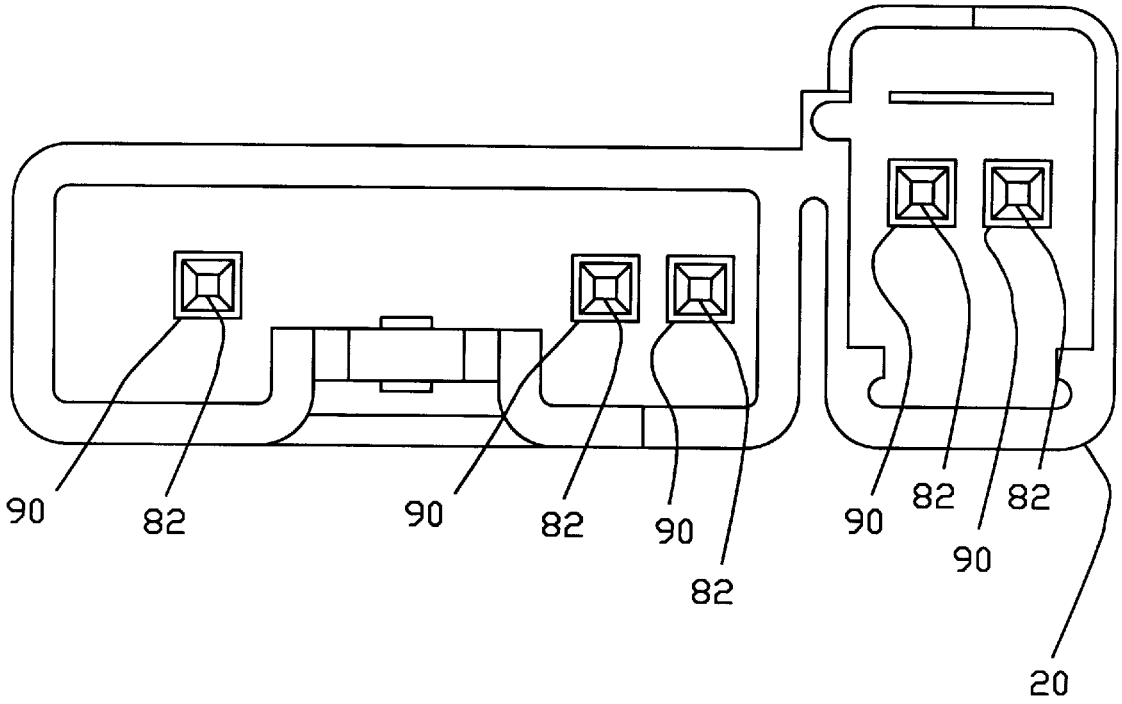
FIG. 8 is a detailed view of FIG. 3 showing the housing and seals in the location of the outer diameter circuit board.

FIG. 8 is a detailed view of FIG. 3 in the area of the outer diameter circuit board 80. Five conductors 82 are shown penetrating through the first seal 90. The seal 90 is shown to be partially positioned between the conductors 82 and the housing 20.

The seals 90, 100, 110, and 120, cover and seal any exposed circuitry within the clockspring 10 as described above. The seals 90, 100, 110, and 120, are preferably made of a material such as silicone, for example EXP1011 and EXP1012 made by Bryant Rubber Corporation. The material of the seals tends to fill any voids between the surfaces of the parts abutting the seals. The seals prevent leakage of liquids through the seal material itself and prevents the leakage of liquid through the interface created between contacting surfaces of the seal and the parts with which the seal abuts.

Applicants note that any material that makes the clockspring water resistant is an adequate sealing material.

Additionally, Applicants note that the following materials and methods also solve the problem of making the clockspring water resistant: epoxy coating any exposed circuitry within the clockspring, overmolding any exposed circuitry of the circuit boards with the material of the circuit board, and using rubber or silicone to cover and seal any of the exposed circuitry within the clockspring.

Applicants' invention does not require sealing material to be placed between the mutually contacting surfaces of the cover 30 and the housing 20, since the sealing function, as discussed in Applicants' disclosure, takes place only at the location of the exposed circuitry. Thus, according to Applicants' invention, a minimum amount of sealing material is required to perform the sealing function.

Obviously, numerous modifications and variations of the present invention are possible in light of the above teachings. For example, the seals discussed above can be used for many alternative electrical connectors for automotive and non-automotive applications. It is therefore to be understood that within the scope of the appended claims, the invention may be practiced otherwise than as specifically described herein.

What is claimed is:

1. A clockspring comprising:

a seal;

a housing;

a cover mounted on the housing forming a cavity therebetween;

an electrical ribbon cable mounted in the cavity; and a circuit board connected to the electrical ribbon cable, the circuit board mounted between the housing and the cover, and wherein the seal being positioned between the circuit board and at least one of the cover and the housing.

2. A clockspring as recited in claim 1 wherein the seal is made of a silicone material.

3. A clockspring as recited in claim 1 wherein the seal is made of a rubber material.

4. A clockspring as recited in claim 1 wherein the seal is made of an epoxy material.

5. A clockspring comprising:

a housing;

a cover mounted on the housing forming a cavity therebetween;

an electrical ribbon cable having a first end, the electrical ribbon cable mounted in the cavity;

an outer diameter circuit board connected to the first end of the electrical ribbon cable, the outer diameter circuit board mounted between the housing and the cover; and a first seal positioned between the housing and the outer diameter circuit board.

6. A clockspring as recited in claim 5, further comprising a second seal positioned between the outer diameter circuit board and the cover.

7. A clockspring as recited in claim 6, further comprising a hub rotatably mounted to at least one of the housing and the cover.

8. A clockspring as recited in claim 7 wherein the electrical ribbon cable has a second end.

9. A clockspring as recited in claim 8, further comprising an inner diameter circuit board connected to the second end of the electrical ribbon cable.

10. A clockspring as recited in claim 9 wherein the inner diameter circuit board being mounted on the hub.

11. A clockspring as recited in claim 10, further comprising a clip mounted to the hub.

12. A clockspring as recited in claim 11, further comprising a third seal positioned between the hub and the inner diameter circuit board.

13. A clockspring as recited in claim 12, further comprising a fourth seal positioned between the inner diameter circuit board and the clip.

14. A clockspring as recited in claim 5 wherein the first seal is made of a silicone material.

15. A clockspring as recited in claim 5 wherein the first seal is made of a rubber material.

16. A clockspring as recited in claim 5 wherein the first seal is made of an epoxy material.

17. A clockspring located in a passenger compartment of an automotive vehicle, the clockspring comprising:

a seal;

a housing;

a circuit board; and an electrical cable connected to the circuit board, and wherein the seal being positioned between the circuit board and the housing.

18. A clockspring of claim 17 wherein the seal is made of a silicone material.

19. A clockspring of claim 17 wherein the seal is made of a rubber material.

20. A clockspring of claim 17 wherein the seal is made of an epoxy material.

* * * * *